US012305461B2

(12) United States Patent
Treadaway

(10) Patent No.: US 12,305,461 B2
(45) Date of Patent: May 20, 2025

(54) LINKAGE SLIP ASSEMBLY FOR HIGHER EXPANSION ON DOWNHOLE TOOL

(71) Applicant: Weatherford Technology Holdings, LLC, Houston, TX (US)

(72) Inventor: Shawn J Treadaway, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/989,324

(22) Filed: Nov. 17, 2022

(65) Prior Publication Data

US 2024/0167353 A1 May 23, 2024

(51) Int. Cl.

| | |
|---|---|
| ***E21B 23/06*** | (2006.01) |
| ***E21B 17/07*** | (2006.01) |
| ***E21B 33/128*** | (2006.01) |
| ***E21B 33/129*** | (2006.01) |

(52) U.S. Cl.

CPC ..... *E21B 23/06* (2013.01); *E21B 33/1293* (2013.01); *E21B 17/07* (2013.01); *E21B 33/128* (2013.01); *E21B 33/1291* (2013.01)

(58) Field of Classification Search

CPC .... E21B 23/06; E21B 33/128; E21B 33/1291; E21B 33/1293; E21B 17/07; E21B 17/10

See application file for complete search history.

(56) References Cited

U.S. PATENT DOCUMENTS

| | | | | |
|---|---|---|---|---|
| 3,977,468 | A * | 8/1976 | Brewer | G01B 5/12 166/241.5 |
| RE36,526 | E | 1/2000 | Braddick | |
| 6,796,380 | B2 | 9/2004 | Xu | |
| 7,832,488 | B2 | 11/2010 | Guerrero et al. | |

(Continued)

FOREIGN PATENT DOCUMENTS

| | | |
|---|---|---|
| EP | 3775478 A1 | 2/2021 |
| GB | 2275951 A | 9/1994 |

(Continued)

OTHER PUBLICATIONS

International Search Report and Written Opinion in counterpart PCT/US2023/033586 mailed Dec. 5, 2023, 12-pgs.

(Continued)

*Primary Examiner* — Nicole Coy
*Assistant Examiner* — Nicholas D Wlodarski
(74) *Attorney, Agent, or Firm* — Cabello Hall Zinda, PLLC

(57) ABSTRACT

A downhole tool, such as a bridge plug, has a carrier disposed on the tool between the opposing cones. Slips are disposed adjacent to the tool between the carrier and the cones. One arrangement has a proximal end of each slip connected by a linkage configured to articulate the proximal end relative to the carrier, while a distal end of each slip is configured to engage the cone opposed thereto. The linkage can be a linkage hingedly connected between the slip's proximal end and the carrier. Alternatively, the linkage can be a leaf spring flexibly connected between the slip's (Continued)

proximal end and the carrier. Another arrangement has linkages hingedly connected to the carrier and hingedly connected toward opposing ends of each slip. The linkages articulate the slip relative to the carrier while the ends of the slip engage the opposing cones.

21 Claims, 4 Drawing Sheets

(56) References Cited

U.S. PATENT DOCUMENTS

| | | | |
|---|---|---|---|
| 7,886,834 | B2 | 2/2011 | Spencer et al. |
| 7,954,563 | B2 | 6/2011 | Mock et al. |
| 8,061,447 | B2 | 11/2011 | Krueger |
| 8,505,623 | B2 | 8/2013 | Williamson |
| 8,528,630 | B2 | 9/2013 | Tunget |
| 8,555,959 | B2 | 10/2013 | Clemens et al. |
| 8,763,686 | B2 | 7/2014 | Burgos |
| 9,416,617 | B2 | 8/2016 | Wiese et al. |
| 9,447,648 | B2 | 9/2016 | Mitchell |
| 9,976,407 | B2 | 5/2018 | Ash et al. |
| 10,633,942 | B2 | 4/2020 | Dockweiler |
| 10,968,712 | B1 | 4/2021 | He et al. |
| 11,649,687 | B1 * | 5/2023 | Dawson ..... E21B 17/1078 166/206 |
| 2004/0031606 | A1 * | 2/2004 | Xu ..... E21B 17/1021 166/213 |
| 2009/0071659 | A1 | 3/2009 | Spencer et al. |
| 2012/0298378 | A1 | 11/2012 | McCauley et al. |
| 2015/0354313 | A1 * | 12/2015 | McClinton ..... E21B 23/06 166/135 |
| 2017/0183927 | A1 | 6/2017 | Herrera et al. |
| 2019/0017340 | A1 | 1/2019 | Clemens et al. |
| 2020/0040679 | A1 | 2/2020 | Mauchien et al. |
| 2021/0108474 | A1 * | 4/2021 | Al Hussin ..... E21B 23/01 |
| 2022/0136349 | A1 | 5/2022 | Mitchell |

FOREIGN PATENT DOCUMENTS

| | | | |
|---|---|---|---|
| WO | 2003054349 | A1 | 7/2003 |
| WO | 2017034584 | A1 | 3/2017 |
| WO | 2022093518 | A1 | 5/2022 |

OTHER PUBLICATIONS

Halliburton, "Hero(TM) Bridge Plug," Brochure, copyright 2020, 2-pgs.
Weatherford, "PBP Bridge Plug," Brochure, copyright 2008, 2-pgs.
Weatherford, "WRP Bridge Plug," Brochure, copyright 2007, 3-pgs.

* cited by examiner

LINKAGE SLIP ASSEMBLY FOR HIGHER EXPANSION ON DOWNHOLE TOOL

BACKGROUND OF THE DISCLOSURE

Different types of downhole tools are deployed and set in a wellbore. For example, FIG. 1 illustrates a wellbore 10 having a downhole tool 20 deployed and set therein. The downhole tool 20 can be a bridge plug used for various operations, such as acidizing, fracturing, cementing, casing pressure tests, wellhead replacement, and zonal isolation. For instance, the bridge plug 20 in FIG. 1 has been run downhole to isolate the wellbore 10 into isolated zones for a fracture operation. In such an operation, operators at the rig 16 perforate casing 12 at a lower zone 14*a* and pump fracture fluid into the casing 12 using a pump system 18. The pumped fracture fluid produces fractures in the formation at the casing's perforations at lower zone 14*a*, and a proppant acts to hold the fractures open.

The bridge plug 20 is then set downhole to isolate portions of the wellbore 10 so another zone 14*b* can be treated. Some bridge plugs 20 are retrievable from the wellbore 10, while others are intended to be permanently set. A retrievable bridge plug 20 can be set downhole using wireline, slickline, or coiled tubing and can temporarily isolate portions of the wellbore 10 for a treatment operation to be performed. Once the operation is completed, the bridge plug 20 can be retrieved.

In some implementations, the bridge plug 20 must be configured for a high expansion application in which a packing element 25 and slips 32 on the bridge plug 20 must expand a considerable amount in the annulus beyond the plug's outer diameter so the packing element 25 and slips 32 can engage with the casing 12. In these high expansion applications, the slips 32 travel completely outside of the outside diameter of the bridge plug 20, which can make setting the bridge plug 20 difficult or can compromise the setting integrity.

FIGS. 2A-2B illustrate portion of a typical slip assembly 30 for high expansion applications according to the prior art. The slip assembly 30 can be used on a downhole tool 20, such as a bridge plug discussed above. The slip assembly 30 is supported on a mandrel 22. The slip assembly 30 includes slips 32 having opposing ends connected by linkages 34, 36 to the mandrel 22 and a portion 24 of the tool 20. To engage the slips 32 outward, the portion 24 of the tool 20 is manipulated relative to the mandrel 22, and the slips 32 pivot on the linkages 34, 36 outwards from the tool 20.

In the current linkage design, the linkages 34, 36 are attached at the ends of the slips 32 and are used to transfer the load of the tool to the slips and into the casing. The linkages 34, 36 that connect to the slips 32 are stressed while the slips 32 are expanded to engage against the surrounding casing. This design also requires specific lengths of the linkages 34, 36 for specific travel to ensure the slips are loaded correctly.

The subject matter of the present disclosure is directed to overcoming, or at least reducing the effects of, one or more of the problems set forth above.

SUMMARY OF THE DISCLOSURE

A downhole tool disclosed herein comprises first and second cone elements, a carrier, and one or more slip elements. The first and second cone elements are disposed opposing one another on the downhole tool. At least one of the first and second cone elements is movable relative to the other of the first and second cone elements. The carrier is disposed on the downhole tool between the first and second cone elements. The one or more slip elements are disposed adjacent to the downhole tool. Each of the one or more slip elements has first and second portions and first and second linkages. The first portion is configured to engage the first cone element, and the second portion is configured to engage the second cone element. The first linkage is connected to the carrier and the first portion and is configured to articulate the first portion relative to the carrier. The second linkage is connected to the carrier and the second portion and is configured to articular the second portion relative to the carrier.

In a first arrangement, the first portion of the one or more slip elements can comprise one or more first slips disposed adjacent to the downhole tool between the carrier and the first cone element, and the second portion of the one or more slip elements can comprise one or more second slips disposed adjacent to the downhole tool between the carrier and the second cone element. Each of the slips has a proximal end and a distal end. The proximal end is connected by the respective linkage to the carrier, and the distal end is configured to engage the respective cone element. Each respective linkage is configured to articulate the proximal end relative to the carrier.

As one alternative in the first arrangement, the first linkage can be a first link being hingedly connected to the proximal end of the respective first slip and being hingedly connected to the carrier. The second linkage can be a second link being hingedly connected to the proximal end of the respective second slip and being hingedly connected to the carrier.

In a further alternative, each of the one or more first and second slips can comprise side linkage arms, and each side linkage arm can be hingedly connected to a side of the respective slip and to an adjacent side of the respective link. For example, each of the side linkage arms can be hingedly connected by a hinge and slot connection to the respective slip.

As another alternative in the first arrangement, the first linkage can be a first bar being flexible. The first bar can be connected to the proximal end of the respective first slip and being connected to the carrier. The second linkage can also be a second bar being flexible, and the second bar can be connected to the proximal end of the respective second slip and being connected to the carrier.

In a second arrangement, the first portion of the one or more slip elements can be a first end of the one or more slip elements, and the second portion of the one or more slip elements can be a second end of the one or more slip elements. The first linkage can be a first link being hingedly connected to the carrier and being hingedly connected to the respective slip element toward the first end, and the second linkage can be a second link being hingedly connected to the carrier and being hingedly connected to the respective slip element toward the second end. In this second arrangement, each of the first and second links can be hingedly connected by a hinge and slot connection to the respective slip element.

For the downhole tool, the carrier can be movable longitudinally on the downhole tool. A plurality of the one or more slip elements can be arranged circumferentially about the downhole tool. The downhole tool can be selected from the group consisting of an anchor, a bridge plug, a packer, and a liner hanger.

For the downhole tool, each of the first and second cone elements can comprise: a first incline disposed on the downhole tool and being configured to engage the respective portion of the one or more slip elements; one or more flaps hingedly connected to the first incline; and a second incline disposed on the downhole tool adjacent to the first incline, the second incline being configured to engage the one or more flaps. The first incline can be movable relative to the carrier, and the second incline can be movable relative to the first incline.

A slip assembly disclosed herein is for use with a downhole tool having first and second cones. The slip assembly comprises a carrier, one or more first slips, and one or more second slips. The carrier is configured to position on the downhole tool between the first and second cones. The one or more first slips are configured to position adjacent to the downhole tool between the carrier and the first cone. Each of the one or more first slips has a proximal end and a distal end. The proximal end is connected by a first linkage to the carrier, and the distal end is configured to engage the first cone. The one or more second slips are configured to position adjacent to the downhole tool between the carrier and the second cone. Each of the one or more second slips has a proximal end and a distal end. The proximal end is connected by a second linkage to the carrier, and the distal end is configured to engage the second cone.

Another slip assembly disclosed herein is for use with a downhole tool having first and second cones. The slip assembly comprises a carrier and one or more slips. The carrier is configured to position on the downhole tool between the first and second cones. The one or more slips are configured to position adjacent to the downhole tool. Each of the one or more slips has first and second ends and first and second linkages. The first end is configured to engage the first cone, and the second end is configured to engage the second cone. The first linkage is hingedly connected to the carrier and is hingedly connected to the respective slip toward the first end. The second linkage is hingedly connected to the carrier and is hingedly connected to the respective slip toward the second end.

The foregoing summary is not intended to summarize each potential embodiment or every aspect of the present disclosure.

DETAILED DESCRIPTION OF THE DISCLOSURE

Figure 2B:
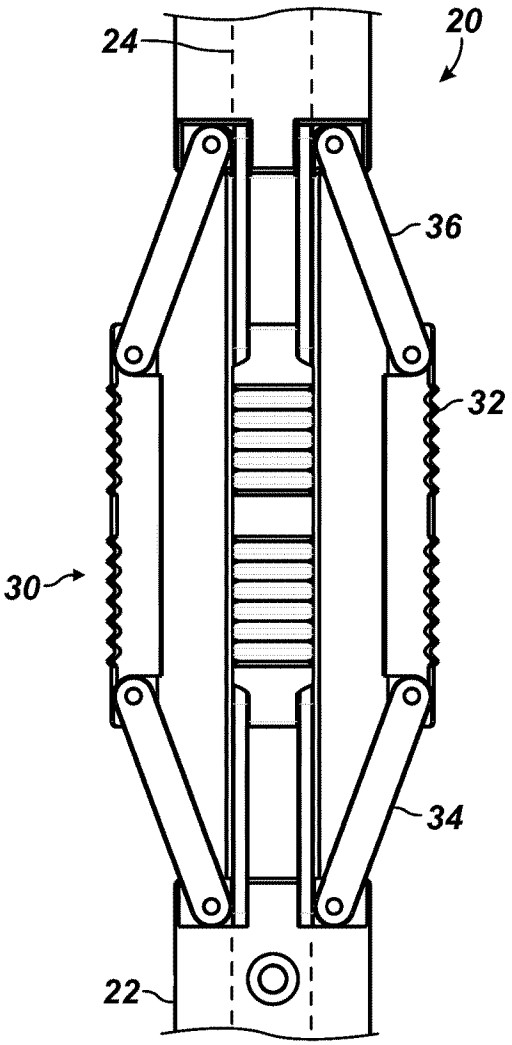
FIG. 2B (Prior Art)
FIG. 2B illustrates the typical slip assembly in an expanded condition.
Figure 2A:
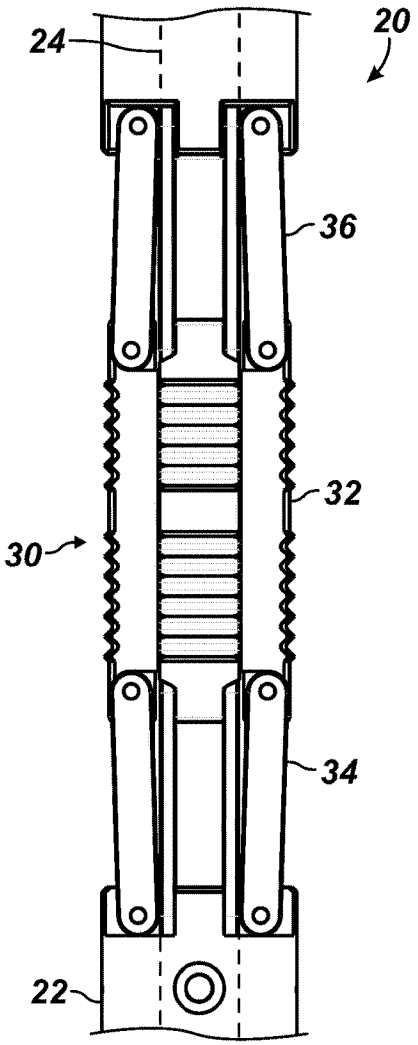
FIG. 2A (Prior Art)
FIG. 2A illustrates a typical slip assembly for expanded engagement according to the prior art in a retracted condition.
Figure 1:
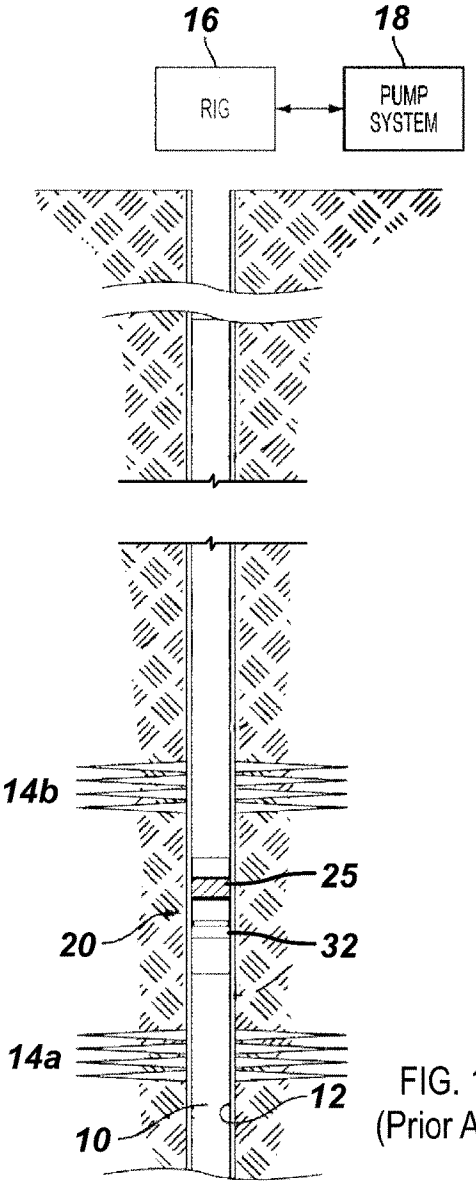
FIG. 1 (Prior Art)
FIG. 1 illustrates a wellbore having a bridge plug deployed and set therein.
Figure 3A:
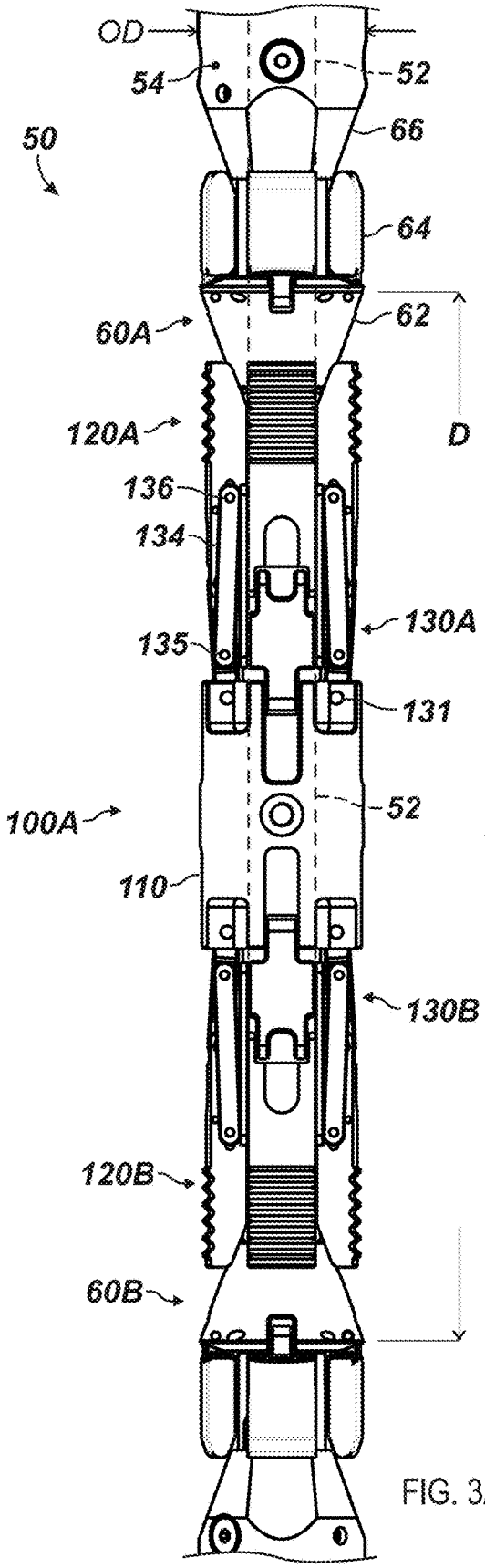
FIG. 3A illustrates a downhole tool having a slip assembly for expanded engagement according to the present disclosure in a retracted condition.
Figure 3B:
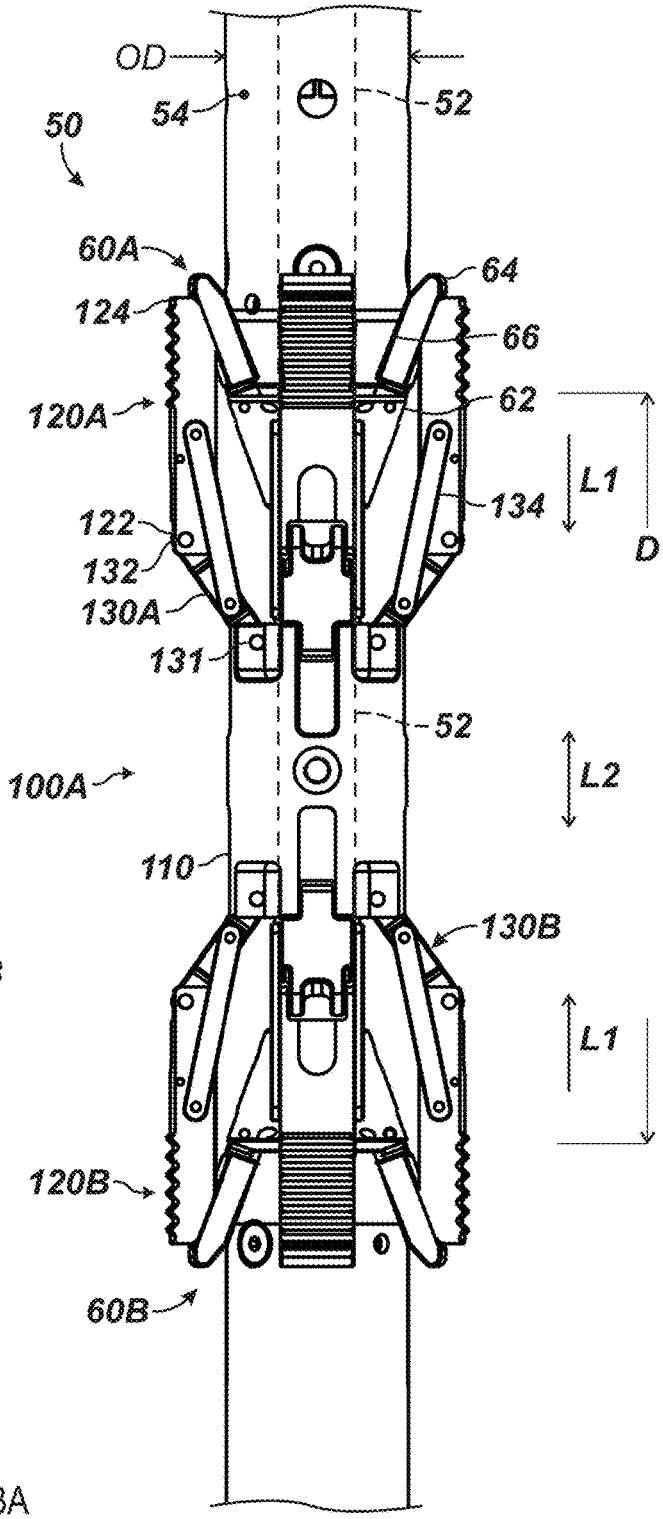
FIG. 3B illustrates the downhole tool having the slip assembly of FIG. 3A in an expanded condition.

FIGS. 3A-3B illustrate a downhole tool 50 having a slip assembly 100A for expanded engagement according to the present disclosure. The slip assembly 100A is shown in a retracted condition in FIG. 3A and is shown in an expanded condition in FIG. 3B. The downhole tool 50 is used in a borehole and has a mandrel 52, body, or the like (shown in dashed lines) on which components of the tool 50 are disposed. As disclosed in general here, the downhole tool 50 can be an anchor, a bridge plug, a packer, a liner hanger, or any other suitable tool to be set downhole in a high expansion situation or even in a normal expansion situation. For instance, in some installations, the downhole tool 50 may need to be run through a small restriction in the tubing or casing, which means that the downhole tool 50 needs to have an outside dimension OD that can pass through the small restriction. However, once the downhole tool 50 has reached setting depth, the slip assembly 100A may need to be expanded well beyond the outside dimension OD of the tool 50 in order to engage the sidewall of the surrounding tubing. The slip assembly 100A of the present disclosure allows for this expansion.

As a bridge plug, the tool 50 can further include a packing element (not shown). The tool 50 can be a wireline retrievable so the tool 50 can be deployed using wireline, slickline, or coiled tubing (not shown) connected by a wireline or hydraulic setting tool (not shown) to a desired point in a borehole casing (not shown). At the desired point, the tool 50 is set using the wireline or hydraulic setting tool (not shown). As the tool 50 is set, its slip assembly 100A engages against the casing or other surrounding tubing, and the tool's packer element (not shown) can isolate the annulus above and below the tool 50.

First and second cone assemblies or elements 60A-B are disposed opposing one another on the tool's mandrel 52. Being opposed, the inclined surfaces of the cone assembles 60A-B face one another toward a central area of the tool 50. At least one of the cone assemblies 60A-B is movable (L1) relative to the other, which can increase and decrease the distance (D) between the assemblies 60A-B. As is typical, an actuator 54, which is only diagrammed here, on the tool 50 can move (L1) one or both of the cone assemblies 60A-B on the mandrel 52. Such an actuator 54 can be mechanical, hydraulic, or any other known mechanism.

The slip assembly 100A is disposed on the mandrel 52 between the cone assemblies 60A-B. The slip assembly 100A includes a carrier 110, slip elements or slips 120A-B, and linkages 130A-B. The carrier 110 is disposed on the mandrel 52. First slips 120A are disposed adjacent to the tool's mandrel 52 between the carrier 110 and the first cone assembly 60A. Each of the first slips 120A has a proximal end 122 and a distal end 124. The proximal end 122 is connected by a first link or linkage arm 130A to the carrier 110, and the distal end 124 is configured to engage the first cone assembly 60A.

In an opposing fashion, second slips 120B are disposed adjacent to the tool's mandrel 52 between the carrier 110 and the second cone assembly 60B. Each of the second slips 120B has a proximal end 122 and a distal end 124. The proximal end 122 is connected by a second link or linkage arm 130B to the carrier 110, and the distal end 124 is configured to engage the second cone assembly 60B.

In general, the slips 120A-B are preferably arranged around the circumference of the tool 50 to provide robust engagement. Sets of four slips 120A-B are shown, but more or less can be used. The carrier 110 is movable longitudinally (L2) on the tool's mandrel 52 and is held laterally adjacent to the mandrel 52. In general, the carrier can be a cylindrical collar or sleeve disposed on the mandrel 52, which is shown in dashed lines. During setting as the distance (D) between the cone assemblies 60A-B is decreased, the carrier 110 is allowed to move longitudinally (L2) along the mandrel 52, adjusting to shifting of the cone assemblies 60A-B and the slips 120A-B.

The links 130A-B shown here are linkage arms or bars. Each linkage arm 130A-B is hingedly connected by a hinge 132 to the proximal end 122 of the slip 120A-B and is hingedly connected by another hinge 131 to the carrier 110. Torsion springs (not shown) can be provided at either one or both of the hinges 131, 132 to bias the linkage arms 130A-B to lay flat against the mandrel 52. The torsion springs (not shown) can thereby urge the slip assembly 100A into the retracted position as shown in FIG. 3A for run-in and pull-out of the tool 50, and the springs can resist premature setting of the assembly 100A until activated. If practical, springs (not shown) can be provided on the mandrel 52 to bias the carrier 110 and urge the slip assembly 100A to the retracted position. As will be appreciated, other types of springs and biasing elements can be used instead of torsion springs.

For further stability, side linkage arms 134 can be hingedly connected to the sides of each respective slip 120A-B. As shown, the side linkage arms 134 can be hingedly connected at 135 to sides of each respective linkage arm 130A-B, although they could be hingedly connected to the carrier 110. These side linkage arms 130A-B can connect with a hinge and slot connection at 136 on the sides of the slip 120A-B. As will be appreciated, the hinge and slot connection 136 can include a hinge that can rotate and slide in a slot. As the slip 120A-B is extended outward, the side linkage arms 130A-B can stabilize the slips 120A-B circumferentially and can make the slips' surface parallel to the longitudinal axis of the tool 50.

Depending on the amount of expansion needed for the slips 120A-B beyond the outside dimension OD of the tool 50, the cone assemblies 60A-C can include one ramp, incline, wedge, or cone 62 against which the slips 120A-B engaged. The present example is configured for greater expansion of the slips 120A-B beyond the outside dimension OD of the tool 50. Therefore, both of the cone assemblies 60A-B have first and second ramps, inclines, wedges, or cones 62, 66 and have extensions or flaps 64.

As with the slips 120A-B, the cone assemblies 60A-B are disposed in opposing relation. For both assemblies 60A-B, the first inner cone 62 is disposed on the tool's mandrel 52, which is shown in dashed lines, and has a first incline configured to engage the distal ends 124 of the respective slips 120A-B. The flaps 64 are hingedly connected to the outer edge of the first cone 62. The flaps 64 can be biased by torsion springs, beam springs, leaf springs, or other biasing elements that urge the flaps 64 to lay flat against the tool 50 and remain within the tool's outer diameter OD when deployed in a borehole. The second outer cone 66 is disposed on the tool's mandrel 52 adjacent to the inner cone 62. The outer cone 66 has a second incline configured to engage the flaps 64.

During deployment as shown in FIG. 3A, the slip assembly 100A and cone assemblies 60A-B are unactuated on the downhole tool 50 so the outside dimension OD of the tool 50 can pass through any restrictions in the borehole.

Activation of the tool 50 is shown in FIG. 3B. During activation, the actuator 54 moves the components of the slip assembly 100A and cone assemblies 60A-B so that the slips 120A-B are expanded outward to engage against the surrounding casing or tubing (not shown). Depending on the implementation, one or both cone assemblies 60A-B can be movable (L1) on the mandrel 52. Moreover, the slip assembly 100A may or may not be moveable (L2) on the mandrel 52 depending on the implementation.

In one particular example, activation by the actuator 54 is generated from the uphole end toward the downhole end of the tool 50. During this activation, the downhole slip 120B is set first, and the uphole slip 120A is then set. To do this, the upper cone assembly 60A and the carrier 110 can ride together along the inner mandrel 52 during activation in the downhole direction. The lower slip 120B is allowed to ramp up the lower cone assembly 60B first. During continued activation in the downhole direction, the carrier 110 is sheared free, and the upper slip 120A can ramp up the cone 62 of the upper cone assembly 60A.

Either way, the distance (D) between the cone assemblies 60A-B is reduced. The distal ends 124 of the slips 120A-B ride up the inclines of the inner cones 62, while the proximal ends 122 pivot on the linkage arms 130A-B. Additionally, the outer wedges 66 move toward the inner cones 62, and the flaps 64 engaged by the outer wedges 66 are fanned outward from the inner cones 62 so the slip's distal ends 124 can ride along additional incline provided by the flaps 64.

As can be seen, the slips 120A-B are supported at both ends 122, 124 and expand outward so that they are parallel to the longitudinal axis of the tool 50. This allows for greater surface area of the slips 120A-B to engage surrounding casing surfaces. Likewise, the slips 120A-B are supported in countering directions so the engagement can resist uphole and downhole forces on the downhole tool 50.

Release of the slip assembly 100A can be achieved by deactivating the actuator 54 so that the distance (D) between the cone assemblies 60A-B can be increased and the slips 120A-B can retract adjacent to the mandrel 52. As noted, springs (not shown) can be used to assist the retraction. For example, torsion springs can be used on the linkage arms 130A-B and on the flaps 64.

Figure 4A:
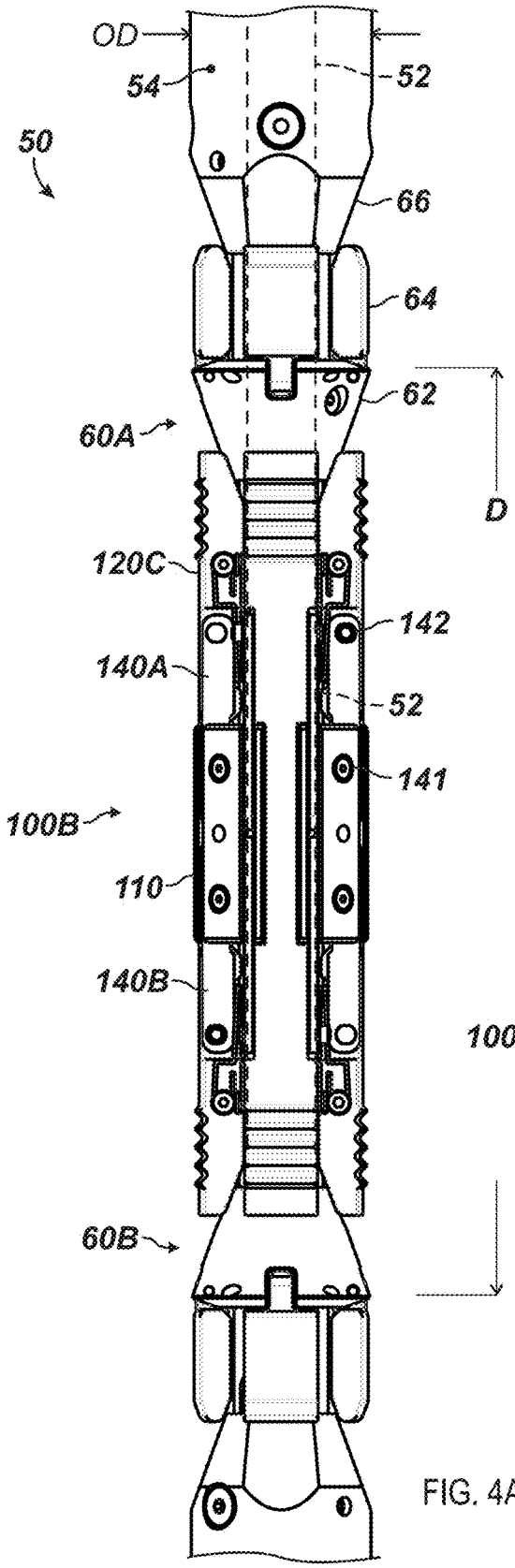
FIG. 4A illustrates a downhole tool having another slip assembly for expanded engagement according to the present disclosure in a retracted condition.
Figure 4B:
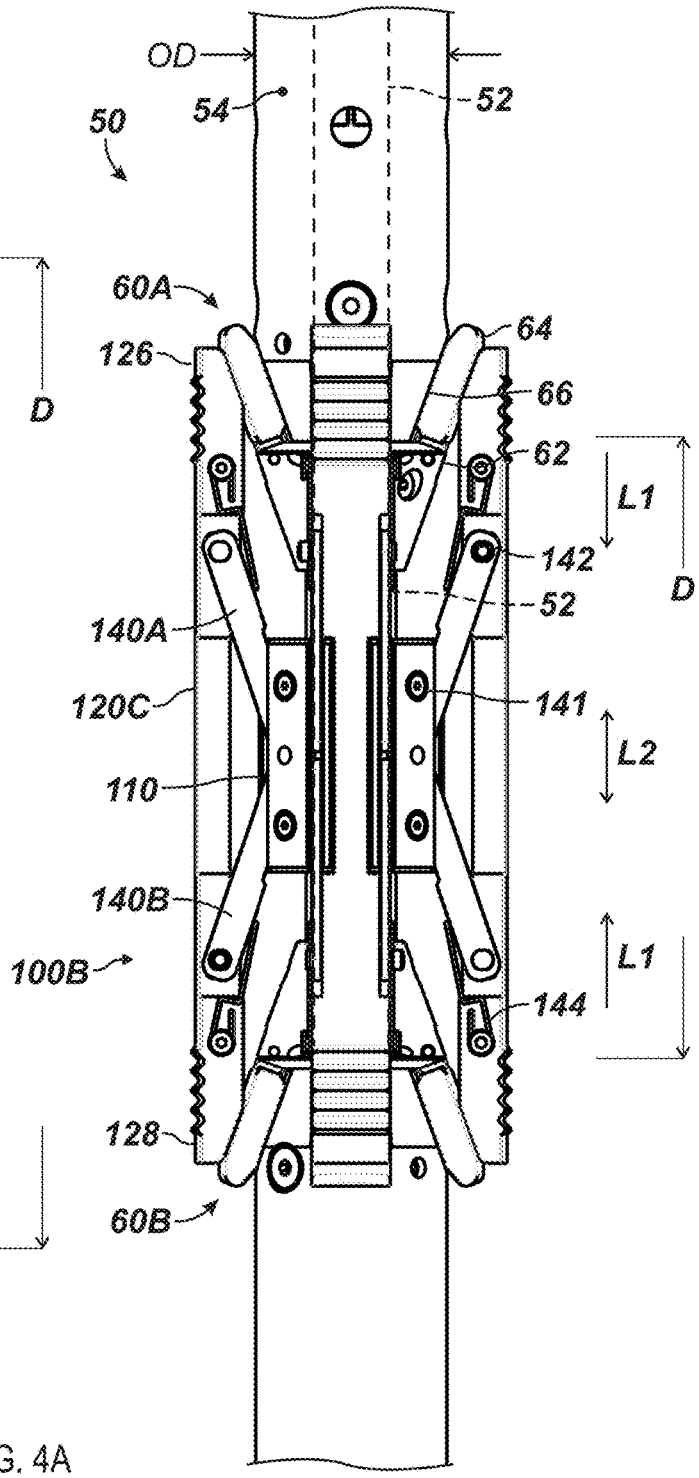
FIG. 4B illustrates the downhole tool having the slip assembly of FIG. 4A in an expanded condition.

FIGS. 4A-4B illustrate a downhole tool 50 having another slip assembly 100B for expanded engagement according to the present disclosure. As before, the slip assembly 100B is shown in a retracted condition in FIG. 4A and is shown in an expanded condition in FIG. 4B. Details of the downhole tool 50 and slip assembly 100B can be similar to those discussed above so the description is reincorporated here. For example, the cone assemblies 60A-B can be comparable to those discussed above.

Again, the first and second cone assemblies 60A-B are disposed opposing one another on the tool's mandrel 52. Being opposed, the inclined surface of the cone assembles 60A-B face one another toward a central area of the tool 50. At least one of the cone assemblies 60A-B is movable (L1) relative to the other, which can increase and decrease the distance (D) between the assemblies 60A-B. As is typical, an actuator 54 on the tool 50 can move (L1) one or both of the cone assemblies 60A-B on the mandrel 52. The actuator 54 can be mechanical, hydraulic, or any other known mechanism.

The slip assembly 100B is disposed on the mandrel 52 between the cone assemblies 60A-B. The slip assembly 100B includes a carrier 110, slips or slip elements 120C, and linkages 140A-B. The carrier 110 is disposed on the mandrel 52, which is shown in dashed lines, and the slips 120C are disposed adjacent to the carrier 110. Each of the slips 120C has opposing first and second ends 126, 128, and each slip 120C connects by sets of links or linkage arms 140A-B to the carrier 110.

The first end 126 of each slip 120C is configured to engage the first cone assembly 60A, and the second end 128 is configured to engage the second cone assembly 60B. The first links 140A can include a pair of side linkage arms or bars hingedly connected at 141 to the carrier 110 and hingedly connected at 142 to each slip 120C toward the first end 126. Although not visible, a hinge and slot connection can be used at 142 to connect the link 140A to the slip 120C. As will be appreciated, the hinge and slot connection 142 can include a hinge that can rotate and slide in a slot. In a similar fashion, the second links 140B can include a pair of side linkage arms or bars hingedly connected to the carrier 110 and hingedly connected to each slip 120C toward the second end 128.

As shown in this example, the pairs of side linkage arms 140A-B are hingedly connected at 142 to opposing sides of each respective slip 120C, which can provide stability. In the present example, four linkage arms 140A-B are provided per slip 120C, but more or fewer arms and pivot points can be used provide travel for the slip assembly 100B. Springs 144 can be engaged between the linkage arms 140A-B and the slips 120C to bias the slips 120C against the mandrel 52.

In general, the slips 120C are preferably arranged around the circumference of the tool 50 to provide robust engagement. Four slips 120C are shown, but more or less can be used. As before, the carrier 110 can be movable longitudinally (L2) on the tool's mandrel 52 and can be held laterally adjacent to the mandrel 52. Additionally, both of the cone assemblies 60A-B can have first and second cones 62, 66 and can have extensions or flaps 64.

During deployment as shown in FIG. 4A, the slip assembly 100B and cone assemblies 60A-B are unactuated on the downhole tool 50 so the outside dimension OD of the tool 50 can pass through any restrictions in the borehole.

Activation of the tool 50 is shown in FIG. 4B. During activation, the actuator 54 moves (L1) the components of the slip assembly 100B and cone assemblies 60A-B so that the slips 120C are expanded outward to engage against the surrounding casing or tubular. Depending on the implementation, one or both cone assemblies 60A-B can be movable (L1) on the mandrel 52. Moreover, the slip assembly 100B may or may not be moveable (L2) on the mandrel 52 depending on the implementation.

Either way, the distance (D) between the cone assemblies 60A-B is reduced. The ends 126, 128 of the slips 120C ride up the inclines of the inner cones 62, while the slips 120C are balanced by the pivoting linkage arms 140A-B. Additionally, the outer wedges 66 move toward the inner cones 62, and the flaps 64 are fanned outward from the inner cones 62 so the ends 126, 128 can ride along additional incline provided by the flaps 64.

As can be seen, the slips 120C are supported at both ends 126, 128 and expand outward so that they are parallel to the longitudinal axis of the tool 50. This allows for greater surface area of the slips 120C to engage surrounding casing surfaces. Likewise, the slips 120C are supported in countering directions so the engagement can resist uphole and downhole forces on the tool 50.

Release of the slip assembly 100B can be achieved by deactivating the actuator 54 so that the distance (D) between the cone assemblies 60A-B can be increased and the slips 120C can retract adjacent to the mandrel 52. As noted, springs can be used to assist the retraction. For example, the springs 144 can be used on the linkage arms 140A-B, and torsion springs, beam springs, leaf springs, or other biasing elements (not shown) can be used on the flaps 64.

Figure 5A:
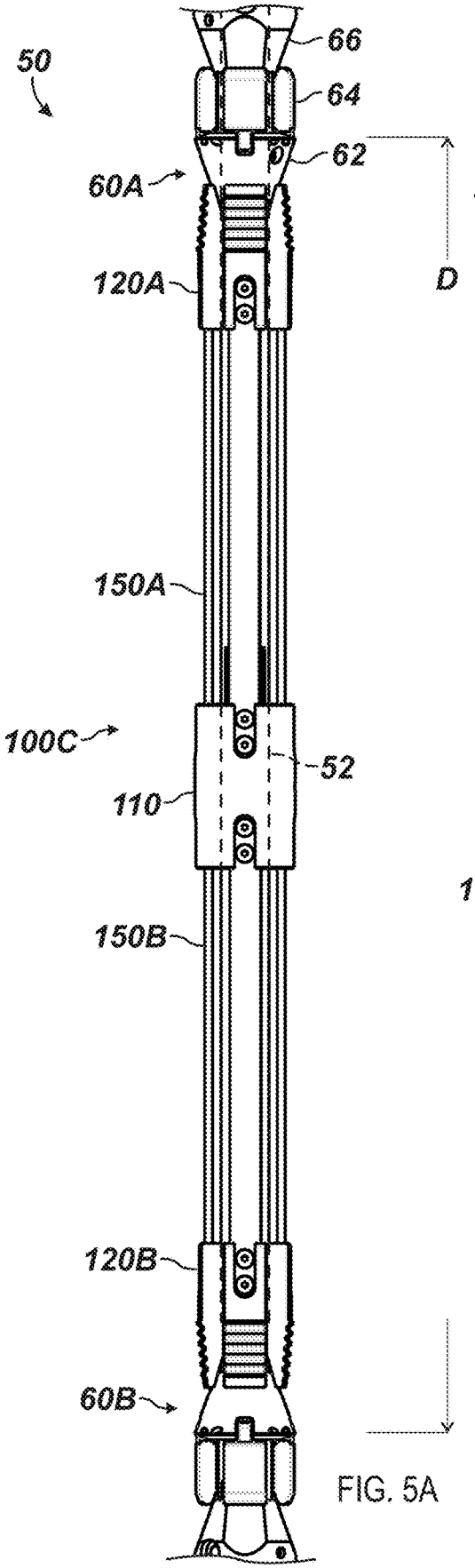
FIG. 5A illustrates a downhole tool having yet another slip assembly for expanded engagement according to the present disclosure in a retracted condition.
Figure 5B:
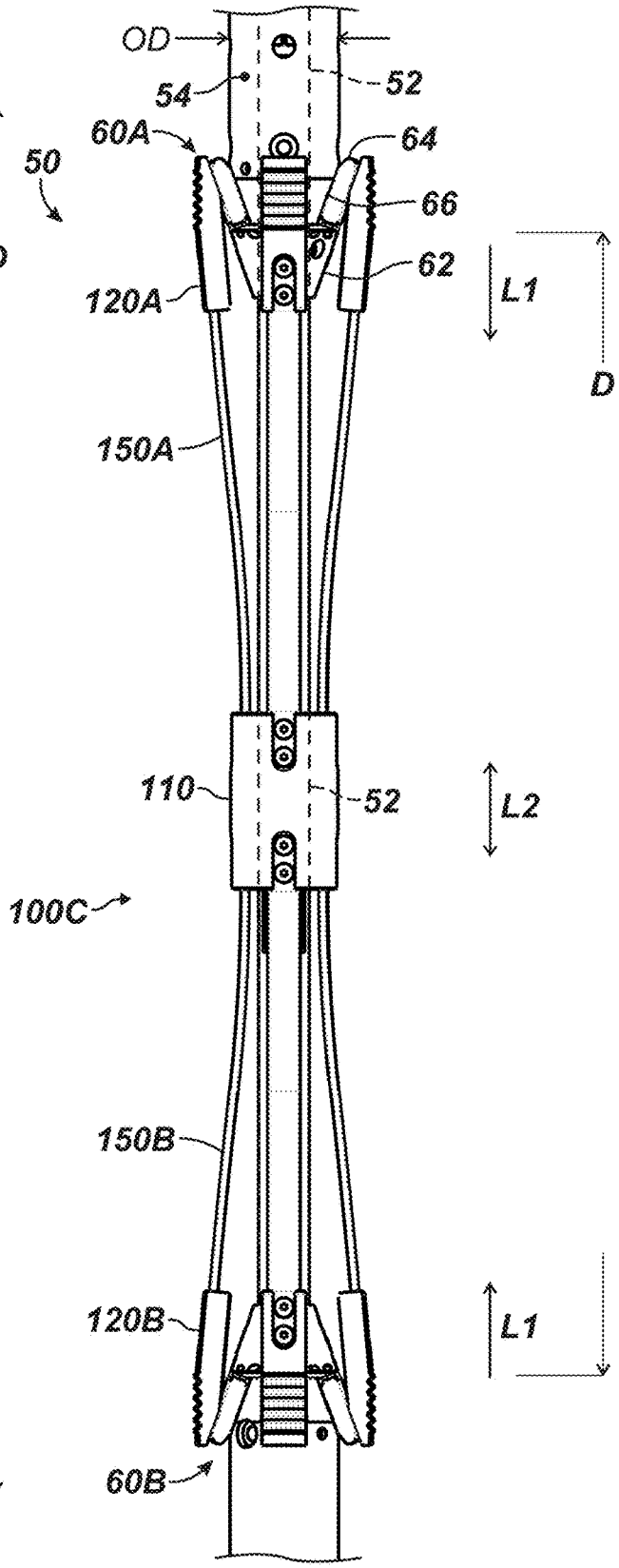
FIG. 5B illustrates the downhole tool having the slip assembly of FIG. 5A in an expanded condition.

FIGS. 5A-5B illustrate a downhole tool 50 having yet another slip assembly 100C for expanded engagement according to the present disclosure. As before, the slip assembly 100 is shown in a retracted condition in FIG. 5A and is shown in an expanded condition in FIG. 5B. Details of the downhole tool 50 and slip assembly 100C can be similar to those discussed above so the description is reincorporated here. For example, the cone assemblies 60A-B can be comparable to those discussed above.

Again, the first and second cone assemblies 60A-B are disposed opposing one another on the tool's mandrel 52. Being opposed, the inclined surface of the cone assembles 60A-B face one another toward a central area of the tool 50. At least one of the cone assemblies 60A-B is movable (L1) relative to the other, which can increase and decrease the distance (D) between the assemblies 60A-B. As is typical, an actuator 54, which is only diagrammed here, on the tool 50 can move (L1) one or both of the cone assemblies 60A-B on the mandrel 52. The actuator 54 can be mechanical, hydraulic, or any other known mechanism. As disclosed in general here, the downhole tool 50 can be a bridge plug and can further include a packer element (not shown).

The slip assembly 1000 is disposed on the mandrel 52 between the cone assemblies 60A-B. The slip assembly 100C includes a carrier 110, slip elements or slips 120A-B, and linkages 150A-B. The carrier 110 is disposed on the mandrel 52, and the slips 120A-B are disposed adjacent to the carrier 110. Distal ends of the slips 120A-B are configured to engage the respective cone assemblies 60A-B.

Each of the slips 120A-B has a proximal end connected by a linkage 150A-B to the carrier 110. The linkages 150A-B include flexible arms, such as leaf springs or spring bars, connected between the carrier 110 and the slips 120A-B.

In general, the slips 120A-B are preferably arranged around the circumference of the tool 50 to provide robust engagement. Sets of four slips 120A-B are shown, but more or less can be used. As before, the carrier 110 can be movable longitudinally (L2) on the tool's mandrel 52 and can be held laterally adjacent to the mandrel 52. Additionally, both of the cone assemblies 60A-B can have first and second wedges or cones 62, 66 and can have extensions or flaps 64.

During deployment as shown in FIG. 5A, the slip assembly 1000 and cone assemblies 60A-B are unactuated on the downhole tool 50 so the outside dimension OD of the tool 50 can pass through any restrictions in the borehole.

Activation of the tool 50 is shown in FIG. 5B. During activation, the actuator 54 moves (L1) the components of the slip assembly 1000 and cone assemblies 60A-B so that the slips 120A-B are expanded outward to engage against the surrounding borehole. Depending on the implementation, one or both cone assemblies 60A-B can be movable (L1) on the mandrel 52. Moreover, the slip assembly 1000 may or may not be moveable (L2) on the mandrel 52 depending on the implementation.

Either way, the distance (D) between the cone assemblies 60A-B is reduced. The distal ends of the slips 120A-B ride up the inclines of the inner cones 62, while the slips 120C flex outward on the flexible arms 150A-B. Additionally, the outer wedges 66 move toward the inner cones 62, and the flaps 64 are fanned outward from the inner cones 62 so the slips' distal ends can ride along additional incline provided by the flaps 64.

As can be seen, the slips 120A-B are supported at both ends and expand outward so that they are generally parallel to the longitudinal axis of the tool 50. This allows for greater surface area of the slips 120A-B to engage surrounding casing surfaces. Likewise, the slips 120A-B are supported in countering directions so the engagement can resist uphole and downhole forces on the tool 50.

Release of the slip assembly 1000 can be achieved by deactivating the actuator 54 so that the distance (D) between the cone assemblies 60A-B can be increased and the slips 120A-B can retract adjacent to the mandrel 52. The flexible arms 150A-B assist in this retraction.

As can be seen, each slip assembly 100A-C disclosed herein includes a center carrier 110 and slips 120A-C. Each slip 120A-C is attached to the center carrier 110 by a linkage 130, 140, 150 (e.g., link, linkage arm, side linkage arm, a spring bar, etc.). Each slip 120A-C is activated by and loaded on an inclined surface of a cone 62.

This allows the slips 120A-C to expand outward on the cone 62 instead of being loaded solely through the linkages 130, 140, 150. The linkages 130, 140, 150 allow the slips 120A-C to expand past the outside dimension OD of the tool 50 while still being connected to the tool 50 at a central location on the carrier 110.

In this disclosed slip assemblies 100A-C, the linkages 130, 140, 150 are instead attached to the slips 120A-C in such a way that the linkages 130, 140, 150 are used to connect and stabilize the slips 120A-C to the tool 50. The slips 120A-C are allowed to expand to the casing while riding up the ramps or inclined surfaces of the cones 62. One link design can be used for multiple inner dimensions of casing or tubing while keeping the load angle between the tool 50 and the slips 120A-C the same for all inner dimensions. Additionally, loading through the cones 62 provides more contact area between the slips 120A-C and the tool 50. Due to the way the slips 120A-C travel and are connected, this provides a more reliable contact between the slips 120A-C and the casing.

Ultimately, the disclosed slip assemblies 100A-C address the issue of retaining a slip to a tool in high expansion applications. The disclosed slip assemblies 100A-C allow a slip to travel completely outside of the outside diameter of the tool 50 while still being retained to the tool 50. Additionally, the disclosed slip assemblies 100A-C allow for a standard engagement of the slip 120A-C to the cone 62 to transmit loads to the casing or tubing.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool, comprising:

a mandrel;

first and second cone elements disposed opposing one another on the mandrel of the downhole tool, at least one of the first and second cone elements being movable longitudinally on the mandrel relative to the other of the first and second cone elements;

a carrier disposed on the mandrel of the downhole tool between the first and second cone elements and being movable longitudinally on the mandrel; and one or more slip elements disposed adjacent to the mandrel of the downhole tool, each of the one or more slip elements having first and second portions and first and second linkages, the first portion of each of the one or more slip elements being configured to engage the first cone element, the second portion of each of the one or more slip elements being configured to engage the second cone element, the first linkage of each of the one or more slip elements connected to the carrier and the first portion and being configured to articulate the first portion relative to the carrier on the mandrel in response to longitudinal movement of the first cone element and the first portion relative to one another, the second linkage of each of the one or more slip elements connected to the carrier and the second portion and being configured to articulate the second portion relative to the carrier on the mandrel in response to longitudinal movement of the second cone element and the second portion relative to one another.

2. The downhole tool of claim 1, wherein:

the first portion of the one or more slip elements comprise one or more first slips disposed adjacent to the mandrel of the downhole tool between the carrier and the first cone element, each of the one or more first slips having a proximal end and a distal end, the proximal end of each of the one or more first slips connected by the first linkage to the carrier, the distal end of each of the one or more first slips being configured to engage the first cone element, the first linkage being configured to articulate the proximal end laterally relative to the carrier on the mandrel in response to longitudinal movement of the distal end and the first cone element relative to one another; and the second portion of the one or more slip elements comprise one or more second slips disposed adjacent to the downhole tool between the carrier and the second cone element, each of the one or more second slips having a proximal end and a distal end, the proximal end of each of the one or more second slips connected by the second linkage to the carrier, the distal end of each of the one or more second slips being configured to engage the second cone element, the second linkage being configured to articulate the proximal end relative to the carrier on the mandrel in response to longitudinal movement of the distal end and the second cone element relative to one another.

3. The downhole tool of claim 2, wherein:

the first linkage is a first link being hingedly connected to the proximal end of the respective first slip and being hingedly connected to the carrier; and the second linkage is a second link being hingedly connected to the proximal end of the respective second slip and being hingedly connected to the carrier.

4. The downhole tool of claim 3, wherein each of the one or more first and second slips comprises side linkage arms, each side linkage arm being hingedly connected to a side of the respective slip and to an adjacent side of the respective link.

5. The downhole tool of claim 4, wherein each of the side linkage arms is hingedly connected by a hinge and slot connection to the respective slip.

6. The downhole tool of claim 2, wherein:

the first linkage is a first bar being flexible, the first bar being connected to the proximal end of the respective first slip and being connected to the carrier; and the second linkage is a second bar being flexible, the second bar being connected to the proximal end of the respective second slip and being connected to the carrier.

7. The downhole tool of claim 1, wherein the first portion of each of the one or more slip elements is a first end of the one or more slip elements; wherein the second portion of each of the one or more slip elements is a second end of the one or more slip elements; wherein the first linkage is a first link being hingedly connected to the carrier and being hingedly connected to the respective slip element toward the first end; and wherein the second linkage is a second link being hingedly connected to the carrier and being hingedly connected to the respective slip element toward the second end.

8. The downhole tool of claim 7, wherein each of the first and second links is hingedly connected by a hinge and slot connection to the respective slip element.

9. The downhole tool of claim 1, comprising a plurality of the one or more slip elements arranged circumferentially about the downhole tool.

10. The downhole tool of claim 1, wherein each of the first and second cone elements comprises:

a first incline disposed on the downhole tool and being configured to engage the respective portion of the one or more slip elements;

one or more flaps hingedly connected to the first incline; and a second incline disposed on the downhole tool adjacent to the first incline, the second incline being configured to engage the one or more flaps.

11. The downhole tool of claim 10, wherein the first incline is movable relative to the carrier; and wherein the second incline is movable relative to the first incline.

12. The downhole tool of claim 1, wherein the downhole tool is selected from the group consisting of an anchor, a bridge plug, a packer, and a liner hanger.

13. A slip assembly for a downhole tool having first and second cones, the downhole tool having a mandrel, the slip assembly comprising:

a carrier configured to position on the mandrel of the downhole tool between the first and second cones and configured to move longitudinally on the mandrel;

one or more first slips configured to position adjacent to the mandrel of the downhole tool between the carrier and the first cone, each of the one or more first slips having a proximal end and a distal end, the proximal end of each of the one or more first slips connected by a first linkage to the carrier, the distal end of each of the one or more first slips being configured to engage the first cone, the first linkage of each of the one or more first slips being configured to articulate the respective first slip relative to the carrier on the mandrel in response to longitudinal movement of the distal end and the first cone relative to one another; and one or more second slips configured to position adjacent to the mandrel of the downhole tool between the carrier and the second cone, each of the one or more second slips having a proximal end and a distal end, the proximal end of each of the one or more second slips connected by a second linkage to the carrier, the distal end of each of the one or more second slips being configured to engage the second cone, the second linkage of each of the one or more second slips being configured to articulate the respective second slip relative to the carrier on the mandrel in response to longitudinal movement of the distal end and the second cone relative to one another.

14. The slip assembly of claim 13, wherein:

the first linkage is a first link being hingedly connected to the proximal end of the respective first slip and being hingedly connected to the carrier; and the second linkage is a second link being hingedly connected to the proximal end of the respective second slip and being hingedly connected to the carrier.

15. The slip assembly of claim 14, wherein each of the one or more first and second slips comprises side linkage arms, each side linkage arm being hingedly connected to a side of the respective slip and to an adjacent side of the respective link.

16. The downhole tool of claim 15, wherein each of the side linkage arms is hingedly connected by a hinge and slot connection to the respective slip.

17. The slip assembly of claim 13, wherein:

the first linkage is a first bar being flexible and being connected to the proximal end and the carrier; and the second linkage is a second bar being flexible and being connected to the proximal end and the carrier.

18. A slip assembly for a downhole tool having first and second cones, the downhole tool having a mandrel, the slip assembly comprising:

a carrier configured to position on the mandrel of the downhole tool between the first and second cones and configured to move longitudinally on the mandrel of the downhole tool; and one or more slips configured to position adjacent to the mandrel of the downhole tool, each of the one or more slips having first and second ends and first and second linkages, the first end of each of the one or more slips being configured to engage the first cone, the second end of each of the one or more slips being configured to engage the second cone, the first linkage of each of the one or more slips being hingedly connected to the carrier and being hingedly connected to the respective slip toward the first end, the second linkage of each of the one or more slips being hingedly connected to the carrier and being hingedly connected to the respective slip toward the second end, the one or more slips configured to move relative to the carrier on the mandrel in response to longitudinal movement of the first and second cones relative to one another.

19. The slip assembly of claim 18, wherein each of the first and second linkages comprises a pair of side linkage arms being hingedly connected to the carrier and being hingedly connected to sides of the respective slip toward the respective end.

20. The slip assembly of claim 19, wherein each of the side linkage arms is hingedly connected by a hinge and slot connection to the respective slip.

21. The downhole tool of claim 1, further comprising an actuator disposed on the downhole tool and being configured to move one or both of the first and second cone elements on the mandrel.

* * * * *